US008113556B2

(12) United States Patent
Dilsiz

(10) Patent No.: US 8,113,556 B2
(45) Date of Patent: Feb. 14, 2012

(54) LIFTING DEVICE

(76) Inventor: Hayrettin Dilsiz, Berlin (DE)

( * ) Notice: Subject to any disclaimer, the term of this patent is extended or adjusted under 35 U.S.C. 154(b) by 123 days.

(21) Appl. No.: 12/449,715

(22) PCT Filed: Feb. 15, 2008

(86) PCT No.: PCT/DE2008/000308

§ 371 (c)(1),
(2), (4) Date: Sep. 17, 2009

(87) PCT Pub. No.: WO2008/101490

PCT Pub. Date: Aug. 28, 2008

(65) Prior Publication Data

US 2010/0320787 A1 Dec. 23, 2010

(30) Foreign Application Priority Data

Feb. 22, 2007 (DE) ..... 10 2007 008 603

(51) Int. Cl.
*B66C 1/66* (2006.01)
*B66C 1/42* (2006.01)
*B66C 1/44* (2006.01)

(52) U.S. Cl. ..... 294/97; 294/158

(58) Field of Classification Search ..... 294/97, 294/93, 96, 81.61, 158, 159; 414/795.6, 414/796.9

See application file for complete search history.

(56) References Cited

U.S. PATENT DOCUMENTS

| | | | | |
|---|---|---|---|---|
| 1,495,179 | A * | 5/1924 | Hoffer | 294/16 |
| 2,670,233 | A * | 2/1954 | Barchoff | 294/97 |
| 2,718,426 | A * | 9/1955 | Nagy | 294/87.1 |
| 4,036,424 | A * | 7/1977 | Thany | 294/93 |
| 5,116,094 | A * | 5/1992 | Jones | 294/61 |
| 7,066,512 | B2 * | 6/2006 | Harris et al. | 294/97 |

FOREIGN PATENT DOCUMENTS

| | | |
|---|---|---|
| DE | 21 60 575 | 6/1973 |
| DE | 20 2005 007464 | 7/2005 |
| EP | 1 396 462 | 3/2004 |

* cited by examiner

*Primary Examiner* — Paul T Chin
(74) *Attorney, Agent, or Firm* — Cozen O'Connor

(57) ABSTRACT

A lifting device for lifting a workpiece provided with a scissor-type linkage having two arms and two rod-like gripping arms connected thereto in an articulated manner. The lifting device also includes a cross member having at least two axially adjacent elongated holes extending in the axial direction of the cross member. The two gripping arms are each guided through an associated elongated hole and are rotatable around an axis extending transverse to the longitudinal direction and transverse to the through-direction of the associated elongated hole and it becomes. As a result, it becomes possible for the free ends of the gripping arms to tilt in an associated lifting opening of the workpiece, i.e., a cylinder head, when a workpiece is lifted.

8 Claims, 2 Drawing Sheets

LIFTING DEVICE

CROSS-REFERENCE TO RELATED APPLICATIONS

This is a U.S. National Stage of International Application No. PCT/DE2008/000308, filed on 15 Feb. 2008. Priority is claimed on German Application No. 10 2007 008 603.4, filed on 22 Feb. 2007.

BACKGROUND OF THE INVENTION

1. Field of the Invention

The invention is directed to a lifting device and, more particularly, to a lifting device for lifting a workpeice.

2. Description of the Related Art

DE 20 2005 007 464 U1 discloses a conventional lifting device. This lifting device has two arms forming pincers, each arm comprising a lifting arm and a gripping arm with a gripping element at its free end. Each arm of the pincers is pivotably mounted between the lifting arm and the gripping arm for opening and closing the pincers. Further, the lifting device has a cross member to which the two arms of the pincers are pivotably connected at a distance from one another, and each of the lifting arms has one or more points of application for connecting nonrigid pulling means.

Other lifting devices are known, for example, from DE 39 07 200 C1, JP 09124267 A, and DD 251 721 A1.

In such known lifting devices, it is often problematic to correctly position the lifting devices in relation to the workpiece to be lifted so as to ensure a secure lifting motion. However, particularly in industrial manufacturing, it is a requirement that the lifting devices can grip the workpiece to be lifted and be connected to it quickly and reliably, all at the same time.

SUMMARY OF THE INVENTION

It is therefore an object of the present invention to provide an improved lifting device which makes it possible to lift a workpiece quickly and securely at the same time.

This and other objects and advantages are achieved in accordance with the invention by a lifting device, such as a device for lifting cylinder heads, which includes a scissor-type linkage having two gripping arms supported at the linkage in an articulated manner and with a cross member such that the two gripping arms of the lifting device can be inserted in a simple manner into associated cylinder head bores, and a tilting of the two gripping arms occurs in the cylinder head bores during the lifting process of the lifting device due to the scissor mechanism such that the cylinder head can be lifted reliably and securely. To this end, the lifting device comprises the above-described scissor-type linkage having two arms, and the two rod-like gripping arms, and a cross member which has at least two axially adjacent elongated holes extending in the axial direction of the cross member. The two gripping arms are each guided through one of the two elongated holes and have a fixing element for preventing the gripping arms from being unintentionally pulled out of the associated elongated hole during the lifting process of the lifting device. During the lifting process of the lifting device, the scissor-type linkage causes a rotation of the two gripping arms around an axis extending transverse to the longitudinal direction of the associated elongated hole and transverse to the through-direction of the associated elongated hole so that the free ends of the gripping arms tilt in the associated lifting openings of the workpiece, i.e, in the cylinder head bores, and accordingly make it possible for the workpiece to be lifted.

Each free end of the gripping arm advisably has an anti-slip coating. In this respect, it is conceivable that an anti-slip coating of this kind, particularly a plastic or rubber coating, protects the cylinder head bores during the insertion of the rod-like gripping arms on the one hand and, on the other hand, prevents the tilted gripping arms from being pulled out of the lifting openings when the workpiece is lifted or at least makes it more difficult for this to happen.

In an embodiment of the invention, a stop element is provided at each gripping arm in the area of the elongated hole, which stop element defines a depth to which the free end of the gripping arm can be inserted into the associated lifting opening on the one hand and, on the other hand, protects an entry area of the lifting openings from damage during the lifting process. The stop element can be constructed, for example, as a typical plastic element, such as a rubber element, and can be dimensioned such that its diameter is greater than the diameter of the associated lifting opening.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

A preferred embodiment example of the invention is shown in the drawing and is described in more detail in the following description.

DETAILED DESCRIPTION OF THE EMBODIMENTS

Figure 1:
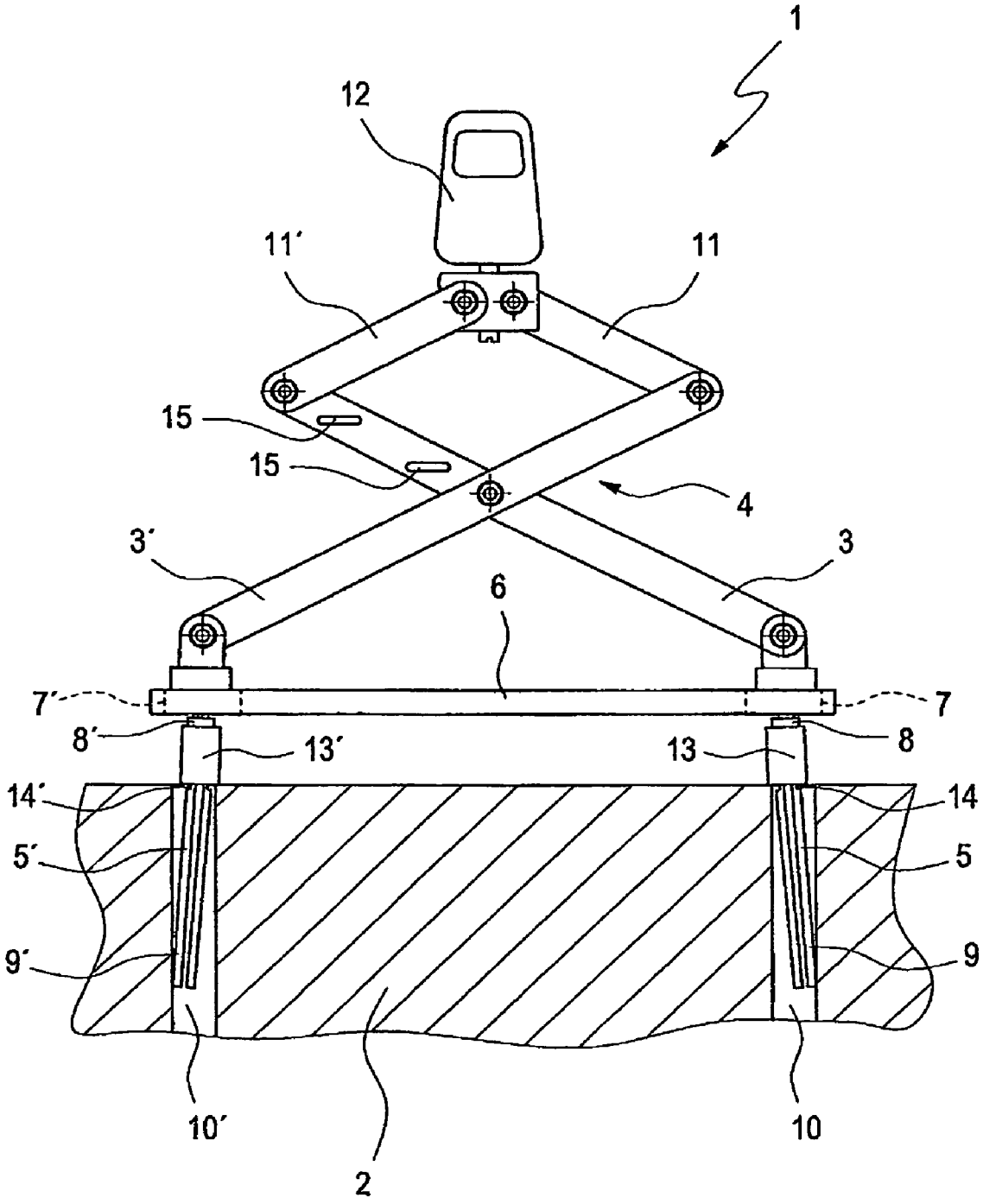
FIG. 1 shows a lifting device in accordance with the invention.

As shown in FIG. 1, a lifting device 1 for lifting a workpiece 2, such as for lifting a cylinder head, includes a scissor-type linkage 4 having two arms 3 and 3' and two rod-like gripping arms 5 and 5' which are connected thereto in an articulated manner. Further, the lifting device 1 comprises a cross member 6 which has at least two axially adjacent elongated holes 7 and 7' extending in the axial direction of the cross member 6. The elongated holes 7 and 7' are respectfully arranged in the area of a longitudinal end of the cross member 6. The two gripping arms 5 and 5' are guided through a respective elongated hole 7, 7' and have a respective fixing element 8 and 8' to prevent the gripping arms 5 and 5' from being pulled out of the associated elongated hole 7, 7' unintentionally. The fixing elements 8, 8' prevent the cross member 6 from falling down during the lifting process of the lifting device 1.

With further reference to FIG. 1, each of the two gripping arms 5, 5' is rotatable around an axis which extends transversely to the longitudinal direction and transversely to the through-direction of the associated elongated hole 7, 7' and which extends substantially perpendicularly to the drawing plane as referring to the sole drawing. As a result, it is possible for the free gripping arm ends 9, 9' to tilt in an associated lifting opening 10, 10' of the workpiece 2 when the latter workpiece is lifted.

At the remote end of the respective gripping arm 5, 5', the two arms 3 and 3' are respectively connected in an articulated manner to a strut 11, 11', respectively, preferably a push/pull strut, with these struts 11, 11' being supported in an articulated manner at their other respective end at a common holding element 12. The lifting device 1 can be fastened to a crane hook, for example, by the holding element 12. The struts 11, 11' are connected to the holding element 12 such that the weight of the scissor-type linkage 4 and the workpiece 2 held at the scissor-type linkage 4 acts symmetrically on the holding element 12. As seen from the Figure, strut 11' is fastened to the holding element 12 in the front in the viewing direction, while strut 11 is fastened to the holding element 12 in the back in the viewing direction.

Figure 2:
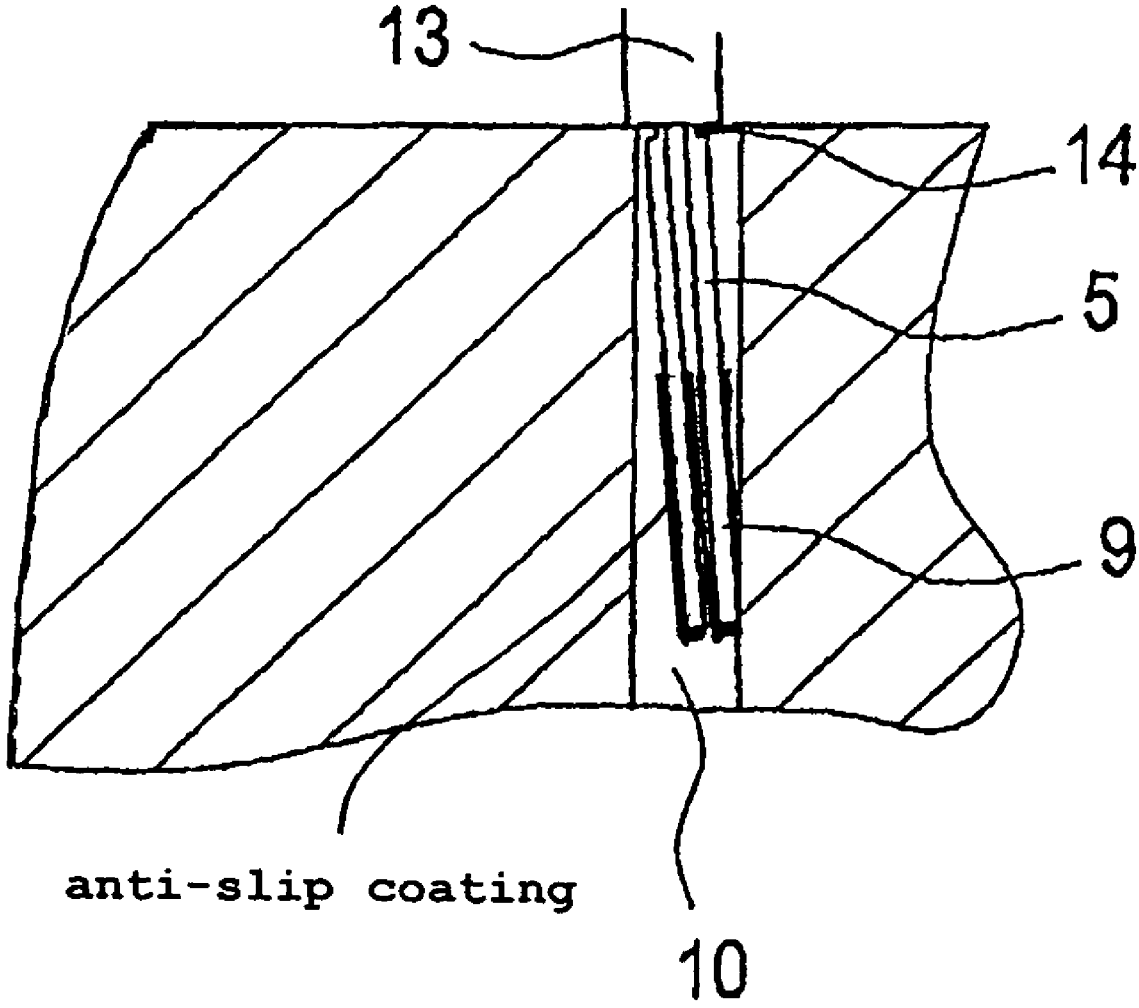
FIG. 2 shows an anti-slip coating at the free end of a gripping arm of the lifting device of FIG. 1.

In order to improve tilting of the free gripping arm ends 9, 9' in the respective associated lifting opening 10, 10', an anti-slip coating for example, a rubber or an elastic plastic, can be additionally arranged at each free gripping arm end 9, 9', as shown in FIG. 2.

The arm 3 is provided with two locking elements 15 which form a stop for the adjoining strut 11' when the scissor-type linkage 4 folds together. The arms 3, 3' are dimensioned such that the distance between the gripping arm ends 9, 9' corresponds to the distance between the lifting openings 10, 10' when the scissor-type linkage 4 folds together (i.e., when the strut 11' stops against the locking element 15 of arm 3) so that the gripping arm ends 9, 9' can be inserted easily into the lifting openings 10, 10'.

A stop element 13, 13' is provided at each gripping arm 5, 5' at its end remote of the free gripping arm end 9, 9' in an area of the associated elongated hole 7, 7'. This stop element 13, 13' defines an insertion depth of the free gripping arm end 9, 9' in the associated lifting opening 10, 10', on the one hand, and prevents damage to an opening rim of the respective lifting opening 10, 10' when the workpiece 2 is lifted by means of the lifting device 1, on the other hand. For this purpose, the stop element 13, 13' can be made of elastic plastic, for example, particularly rubber. The gripping arm end 9, 9' is provided with a notch serving in an area adjacent to the stop element 13, 13' to prevent damage to the edges of the bore openings 10, 10' on the workpiece 2 during lifting and/or transporting.

The articulated connections between the individual arms 3, 9 and 11 are produced by commercially available screw connections.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A lifting device for lifting a workpiece, comprising:

a scissor-type linkage having two arms;

a plurality of rod-like gripping arms connected in an articulated manner to the scissor-type linkage;

a cross member having a plurality of axially adjacent elongated holes extending in an axial direction of the cross member;

wherein each of said plural rod-like gripping arms is guided through an associated elongated hole of the cross member and has a fixing element for preventing each of said plural rod-like gripping arms from being unintentionally removed from the associated elongated hole; and wherein each of said plural rod-like gripping arms is rotatable around an axis extending transverse to a longitudinal direction and transverse to a through-direction of the associated elongated hole to enable a free end of each of said rod-like gripping arms to tilt in an associated lifting opening of the workpiece when said workpiece is lifted.

2. The lifting device according to claim 1, wherein the lifting opening of the workpiece is a bore in a cylinder head.

3. The lifting device according to claim 2, further comprising:

a stop element provided at each of said plural gripping arms in an area of the elongated hole, said stop element defining a depth to which the free end of each of said plural rod-like gripping arms is insertable into the associated lifting opening.

4. The lifting device according to claim 3, wherein the stop element is made of plastic.

5. The lifting device according to claim 2, further comprising:

a stop element provided at each of said plural gripping arms in an area of the elongated hole, said stop element defining a depth to which the free end of each of said plural rod-like gripping arms is insertable into the associated lifting opening.

6. The lifting device according to claim 1, wherein each free end of each of said plural rod-like gripping arms has an anti-slip coating.

7. The lifting device according to claim 6, further comprising:

a stop element provided at each of said plural gripping arms in an area of the elongated hole, said stop element defining a depth to which the free end of each of said plural rod-like gripping arms is insertable into the associated lifting opening.

8. The lifting device according to claim 2, wherein each free end of each of said plural rod-like gripping arms has an anti-slip coating.

* * * * *